United States Patent [19]

Graham

[11] Patent Number: 4,927,152

[45] Date of Patent: May 22, 1990

[54] PORTABLE GOLF SWING TRAINING AID

[76] Inventor: Janice C. Graham, Rte. 4, Box 129, Miami, Okla. 74354

[21] Appl. No.: 381,379

[22] Filed: Jul. 18, 1989

[51] Int. Cl.[5] ..... A63B 69/36

[52] U.S. Cl. ..... 273/186 R; 273/191 R

[58] Field of Search ..... 273/186 R, 186 C, 183 R, 273/191 R, 191 A, 191 B, 192, 186 B

[56] References Cited

U.S. PATENT DOCUMENTS

| | | | |
|---|---|---|---|
| 1,944,942 | 3/1930 | MacDonald | 273/191 A |
| 2,520,287 | 9/1948 | Plunkett et al. | 273/191 A |
| 2,713,491 | 4/1952 | Plunkett et al. | 273/191 A |
| 2,756,056 | 3/1954 | Zega | 273/191 A |
| 2,813,721 | 6/1954 | Zega | 273/191 A |
| 3,339,927 | 5/1965 | Nunn | 273/191 R |
| 3,482,838 | 12/1967 | Bibson et al. | 273/191 R |
| 3,583,707 | 1/1969 | Fujimoto | 273/191 A |
| 3,730,531 | 3/1972 | Zega | 273/191 A |
| 3,744,799 | 3/1972 | Hightower | 273/183 R |
| 3,753,563 | 8/1973 | Previte | 273/186 C |
| 4,040,633 | 2/1976 | Sciarrillo | 273/191 A |
| 4,071,251 | 7/1976 | Beckish | 273/186 R |

*Primary Examiner*—George J. Marlo

[57] ABSTRACT

A golf swing aid including spaced apart U-shaped members adjustably mounting arcuate tubular members between which a golf ball is positioned and the head of a golf club is swung. The U-shaped member most distant from the golfer is collapsible for storage. Attachment devices are provided for securing the U-shaped members either outdoors to the ground or to an indoor supporting surface. The arcuate tubular members can be mounted at either end of the swing aid for use by both right and left handed golfers.

8 Claims, 2 Drawing Sheets

PORTABLE GOLF SWING TRAINING AID

DISCUSSION OF THE PRIOR ART

Several patents were discovered during a search of this invention which basically fall into two different classes. The first class of patents are U.S. Pat. Nos. 2,813,721 issued to F. Zega, 3,730,531 issued to Frank J. Zega, 3,339,927 issued to R. R. Nunn, 2,713,491 issued to J. A. Plunkett et al., 3,583,707 issued to Michinori Fujimoto, 1,944,942 issued to R. G. MacDonald, 2,756,056 issued to F. Zega, 3,744,799 issued Cooper Hightower, 4,040,633 issued to Frank A. Sciarrillo and 2,520,287 issued to J. A. Plunkett et al. Each of these patents described a substantially large device having complete or substantially complete arcuate members which extend from the point of impact of a golf ball completely around the golfer so that the swing is fully controlled at all times. Such teaching aids are extremely cumbersome and must be normally installed at a fixed location and remain at that fixed location since they are too cumbersome to move or disassemble for transportation from one location to another.

The remaining patents, U.S. Pat. Nos. 3,482,838 issued to S. H. Gibson et al. and 4,071,251 issued to John Beckish relate to apparatus which are more compact and could, perhaps, be transported from one location to another. U.S. Pat. No. 3,482,838 illustrates a patent which will regulate only the swing as it leaves the golf ball after the golf ball has been impacted by a golf club. Such device will not improve the back swing of a golfer.

U.S. Pat. No. 4,071,251 is the closest patent found during the search of the prior art and is a fairly complex apparatus which would be extremely difficult to disassemble. It does illustrate control of both the down swing and the follow through swing of a golf club between two large arcuate members which are not able to be easily disassembled for purposes of forming a compact disassembled golf swing training aid. Such an apparatus can not be easily transported in an automobile or small suitcase to a location to be used. Furthermore, this patent does not appear to be suitable for a golfer with a left hand golf swing, but appears only suitable for a golfer with a right hand golf swing.

BRIEF DESCRIPTION OF THE INVENTION

This invention describes a portable and collapsible golf swing aid which essentially is made of a pair of spaced members, each one of which has means for securing it vertically to a rigid surface, such as the ground or a board, for example. A bar is attached between the first pair of spaced members to form a substantially "U" shaped member. The bar extends past each of the first pair of spaced members so that an arcuate extension can be attached to either end of the bar. A second pair of spaced members is secured vertically to the same rigid surface as the first pair of spaced members and separated from the first pair of spaced members. A second bar is attached to the second pair of spaced members and extends passed the vertical spaced members so that a second arcuate member can be attached thereto. The second pair of spaced members essentially comprises rotatable horizontal elements which are attached between the vertical members and the bar member so that a space is provided for the golf club to pass thereunder.

All of the arcuate members are made so that they can be separated from the bar members and then again separated into at least two pieces so that they can be easily stored. Furthermore, the arcuate members are attached to the bar members in a manner so that they can be rotated about the longitudinal axis of the bar members, thereby providing for different height people and for accommodating beginners, advanced and professional golfers. Furthermore, the arcuate members can be attached to either end of the bar members so that the apparatus can accommodate either a golfer with a right hand swing or a golfer with a left hand swing. The bar members themselves can be folded into a compact unit.

The invention can also accommodate several surfaces by having snap in and snap out surface attachments such as a probe for inserting into the ground or an "L" shape member for attachment to a board or mat. Thus, a very versatile golf swing training device is disclosed which can be completely disassembled and packed in a small container for transportation to a site to be used or for storage when at home or at an office.

DETAILED DESCRIPTION OF THE INVENTION

Figure 1:
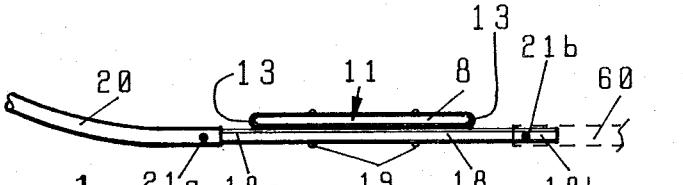
FIG. 1 is a top view of the golf swing training apparatus installed on a rigid surface, showing the alternate positions for the arcuate members.
Figure 2:
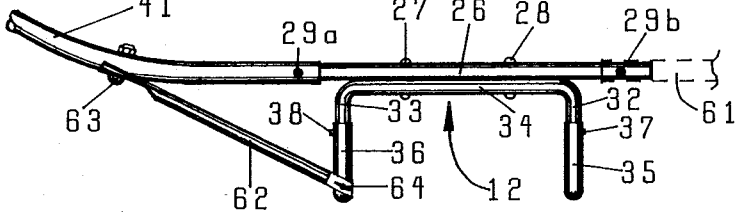
FIG. 2 is a side view of the apparatus illustrated in FIG. 1.
Figure 2:
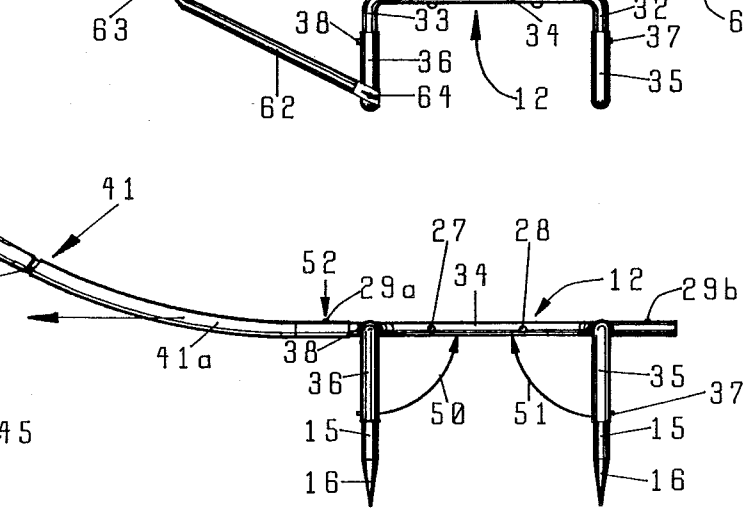
Figure 5:
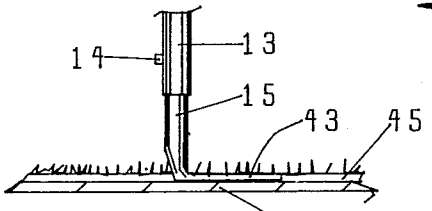
FIG. 5 illustrates the insert provided for attachment to a flat surface, such as a board or mat.
Figures 3, 4, 7:
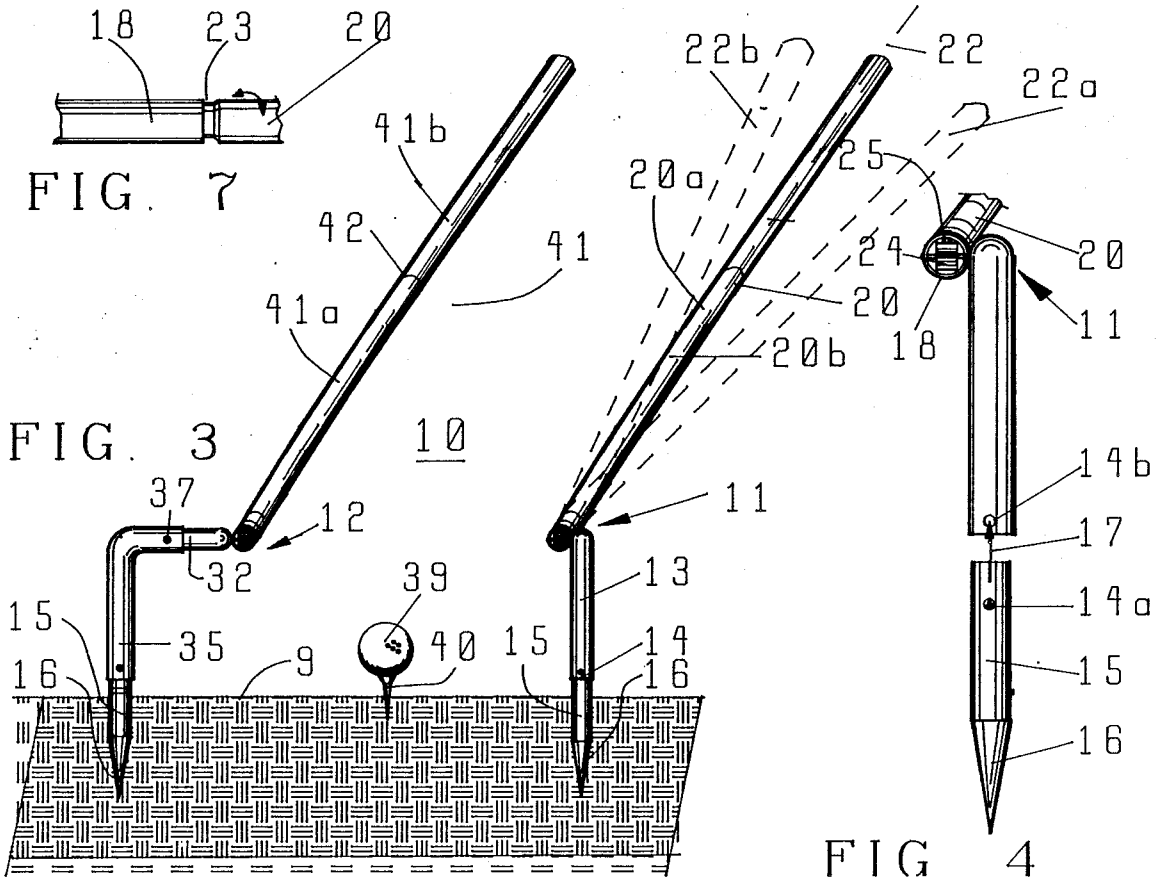
FIG. 3 is the end view of the apparatus illustrated in FIG. 1 showing the possible actual adjustments for the arcuate members.
FIG. 4 is a detail of the assembly of the ground attachment probes into the spaced members.

Referring to all of the FIGURES, but in particular to FIGS. 1, 2 and 3, a golf swing teaching aid generally referred to by arrow 10 essentially comprises a first "U" shaped member referred to by arrow 11 and a second "U" shaped member referred to by arrow 12. "U" shaped member 11 essentially comprises horizontal portion 8 and a pair of vertical attachment devices 13 which are, in the preferred embodiment, constructed of tubular aluminum bent to form an "U" shape. At the open end of "U" shape member 11 is a locking hole **14*b*. A surface engagement member 15 can have a pointed end 16 or an "L" shaped end to be described when FIG. 5 is described. Surface engagement member 15 has a snap lock 14 which includes a lock portion 14*a* adapted to be received into locking hole 14*b* when surface engagement member 15 is moved in the direction of arrow 17 (see FIG. 4) until lock portion 14*a* passes into hole 14*b*, thereby securing surface engagement member 15 to vertical attachment device 13. Since vertical attachment device 13 has two downwardly extending ends, two surface engagement members 15 will be required for each downwardly extending end. A horizontal bar 18 is attached by a pair of rivets or screws 19 to a horizontal portion of vertical attachment device 13. Bar 18 has extensions 18*a* and 18*b* which are adapted to receive an arcuate member referred to by arrow 20. Extensions 18*a* and 18*b* each have means for positioning and securing arcuate member 20. In the FIGURE illustrated, this means of positioning and securing are snap locks 21***a* and 21*b* which pass into an opening provided in arcuate member 20 thereby positioning arcuate member 20. It is desirable in many occasions to have arcuate member 20 adaptable for positioning in one of several positions, such is illustrated as 22 in FIG. 3. It can also have other arcuate positions 22*a* and 22*b*, for example, illustrated by dotted lines. Furthermore, there can be selected positions any where between positions 22*a* and 22*b* or positions outside as those illustrated as 22*a* and 22*b*. These positions can be fixed positions in which case additional holes can be placed in arcuate member 20 to accommodate one of several positions, or rotating joints can be provided at 21*a* and 21*b* rather than snap locks 14 as illustrated. Such rotating joints are well known in the art and will not be further described except as reference is made to FIG. 7 where in FIG. 7 horizontal bar 18 is illustrated attached to arcuate member 20 by means of a slip joint 23.

Basically, arcuate member 20 has a reduced portion at 23 which slides into horizontal bar 18 and is forced to a location desired by the person obtaining the golf swing training. Such a position accommodates the golfer's swing abilities and the like. Other rotating joints well known in the art can also be incorporated and are still well within the spirit of this invention. Such rotating joints are numerous and will not be disclosed herein.

For those unfamiliar with snap locks, a snap lock is better illustrated in FIG. 4 and essentially comprises a "V" shaped member 24 which can be made of a springy material such as metal or plastic. One end of "V" shaped member 24 has a pin 25 protruding through a hole in horiztonal member 18. In ordinary use, pin 25 is depressed and the mating member having a hole therethrough is slipped over horizontal bar 18 until its mating hole engages pin 25 whereupon pin 25 protrudes up through the mating hole locking the two pieces from being rotated and from being removed. As previously discussed, snap locks are well known in the art and not part of this invention.

Figure 6:
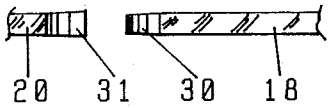
FIG. 6 illustrates an alternate construction method for the apparatus utilized in all of the FIGURES; and, FIG. 7 shows the rotatable attachment particularly disclosed and illustrated in FIG. 3.

Furthermore, other locking type arrangements can be accommodated as is illustrated in FIG. 6. If, for example, horizontal bar 18 is made of a tubular section having a square cross-section with a taper 30, then arcuate member 20 can have a mating taper 31. Taper 31 can then be forced over taper 30, locking arcuate member 20 onto horizontal bar member 18. The square cross-section prevents rotation of the device.

In the embodiment illustrated, as made from the device shown in FIG. 6, a physical rotation device would have to be included in either horizontal bar 18, if arcuate member 20 is to be rotated or the rotating joint would have to be placed in arcuate member 20. In either case, arcuate member 20 will be securely locked to horizontal bar 18 and prevent arcuate member 20 from rotating about horizontal bar 18. It is also understood that if a particular angle is to be used by the same golfer, then arcuate member 20 need be forcibly rotated until the proper angle is reached whereupon arcuate member 20 will receive a permanent bend and accommodate the particular golfer for his continuous swing practice.

Second "U" shaped member 12 has first and second horizontal portions 32 and 33, respectively, which are attached to a connecting horizontal portion 34. It is secured to a second horizontal bar 26 by means of pins or rivets 27 and 28 and has similar snap lock arrangements 29*a* and 29*b* as illustrated for horizontal bar 18. Horizontal portions 32 and 33 are subsequently rotatably connected to "L" shaped members 35 and 36, respectively. Each of "L" shaped members 35 and 36 has a downwardly extension portion which is adapted to receive surface engagement member 15 as previously described for vertical attachment device 13. If the device is to be mounted in ground 9, then pointed end 16 will be connected to surface engagement member 15 as previously described. Horizontal portions 32 and 33 each have a snap lock 37 and 38, respectively, used to accurately position "L" shaped member 35 with respect to horizontal portion 32.

The entire configuration of second "U" shaped member 12 is for the purpose of providing clearance for the golf club head as the club is swung toward golf ball 39 which is resting normally on a tee 40.

Referring in particular to FIG. 2, an arcuate portion 41 is comprised of two sections 41*a* and 41*b* which are attached to each other by a slip lock 42. Slip lock 42 can obviously be any of a number of locks, such as a snap lock, they can be physically bolted together or one of any other number of ordinary means for connecting two tubular members together. The main reason for providing arcuate members 20 and 41 with means for division is that the portability of the unit is enhanced when arcuate members 20 and 41 can be reduced to a reasonable length. Arcuate adjustments of arcuate member 41 have not been illustrated as was the arcuate adjustments of arcuate member 20. However, the same locking apparatus can be put on both arcuate members 20 and 41.

Referring to FIG. 5, a board attachment is illustrated for "L" shaped member 35 or vertical attachment device 13, for example. In this example, vertical attachment device 13 has a surface engagement member 15 having the downwardly portion of surface engagement member 15 inserted into vertical attachment device 13 and locked into place by snap lock 14. An "L" shaped attachment 43 is formed to surface engagement member 15 and may be attached to a board 44 by any ordinary means such as screws, nails or rivets and the like. Artificial turf 45 can be placed over board 44 and "L" shaped attachment 43 to hide "L" shaped attachment 43 and present a better surface for the utilization of golf swing training aid 10.

OPERATION

The operation of golf swing training aid 10 is as follows: in case golf swing training aid 10 is being used in a surface such as ground 9, then golf swing training aid 10 is unpacked in the normal packing state in the unassembled condition. When golf swing training aid 10 is unpacked it essentially consists of vertical attachment device 13 with its attached horizontal bar 18 and arcuate members 20 which are formed of two pieces, the downwardly extending surface attaching members may or may not have been removed. If they have been removed by depressing snap locks 14, for example, then they will likewise be separated from downwardly extending portion of vertical attachment device 13. Second "U" shaped device 12 will consist of horizontal connecting portion 34 and each of horizontal connecting portions 32 which are, as previously discussed, rotatably connected to "L" shaped portions 35 and 36. However, "L" shaped portions 35 and 36 have been additionally collapsed by pushing on snap locks 37 and 38 which released "L" shaped portion 36 from horizontal portion 33 and "L" shaped portion 35 from horizontal portion 32 and permit rotation as in the direction of arrows 50 and 51. Thus, second "U" shaped member 12 can be substantially reduced in its dimension by folding the legs as illustrated in the direction of arrows 50 and 51. In addition, surface engagement member 15 can be removed as previously described. Arcuate portion 41 will be removed from snap lock 29*a* by depressing, in the direction of arrow 52, when packed and then arcuate portion 41 is separated at joint 42 into portions 41*a* and 41*b*. The extra surface engagement member 15, as illustrated in FIG. 5, for attachment to board 44, furthermore, can be included in the kit and used as desired or can be permanently attached to a board and provide removal by merely depressing snap locks 14 for each of the legs or downwardly extending members for "U" shaped members 11 and 12, thereby releasing these members for use in ground 9 or for storing.

When the apparatus is to be assembled, normally second "U" shaped member 12 is inserted into ground 9 first to a depth so that pin 26 is about eight inches from the surface of ground 9. Then, first "U" shaped member 11 is inserted into ground 9 with its horizontal bar 18 substantially parallel to pin 26 and slightly lower than pin 26, by one to two inches, for example, or that dimension can be varied as desired by the person practicing his or her golf swing. The spacing between horizontal bar 18 and pin 26 depends upon the skill of the swinger. The spacing may be substantial for a beginning golf person and fairly close for a more skilled golf swing trainee. Golf ball 39 can be placed on tee 40 and inserted into ground 9 at approximately the location illustrated. However, this too can be varied depending upon the person using golf swing training aid 10.

In order to ready second "U" shaped member 12, "L" shaped members 35 and 36 must be rotated opposite the arrows illustrated in FIG. 2 until snap locks 37 and 38 engage, thereby rigidly positioning "L" shaped members 35 and 36 as illustrated in FIGS. 1 and 2.

With reference to FIG. 3, arcuate members 20 and 41 are then reassembled by inserting the ends into snap lock 21*a*. Arcuate member 41 then has its segments 41*a* and 41*b* assembled and inserted into snap lock 29*a*. The angle, as illustrated in FIG. 3, is dependent upon the height and skill of the golfer and may be varied as desired as illustrated between position 22, 22*a* and 22*b* to provide a completely universal golf swing training device for any person desiring to learn to swing a golf club. Furthermore, arcuate member 41 will then need to be adjusted to a desired angle, probably parallel to the selected angle of arcuate member 20.

The rotation of arcuate members 20 and 41 are provided by a slip joint illustrated, for example, in FIG. 7. Any type slip joint can be provided and still be well within the skill of this invention. It should be understood that snap locks have been illustrated as a convenient means for attaching one tubular member to another. If, for example, the members rather than being tubular are solid, then each of the attachments can be screwed or threaded together or if they are square, as illustrated in FIG. 6, then tapered joints can be utilized or other types of well known joints. The invention is not limited by the particular joint disclosed, since the particular joint disclosed is only illustrated for convenience.

LEFT HAND GOLFER

In the event a golfer is left handed, then arcuate member 20 can be removed and reinserted into position 60 as illustrated in FIG. 1 and arcuate member 41 can be removed and reinserted into location 61 so that the left hand golfer has the same benefit of a golf swing aid as does the right hand golfer.

OTHER COMPONENTS

In the event it is desired to protect "L" shaped members 35 or 36 or for that matter, any portion of the horizontal or vertical members of second "U" shaped member 12, then a deflector can be added which would essentially comprise a tubular portion 62 which can be attached at 63 to arcuate member 41 and attached at 64 to "L" shaped member 36. Furthermore, deflector 62 can be positioned on the opposite side and be attached to "L" shaped member 35 in exactly the same manner as illustrated. Furthermore, other types of deflector units can be used such as an arcuate piece mounted between horizontal portions 33 and horizontal this invention.

CONCLUSIONS

An extremely versatile, transportable golf swing training device has been disclosed. Such device can be completely disassembled and packed into a small package and it can be transported and reassembled at the use location with ease and comfort by the person doing the reassembly. Furthermore, the assembly is so simple any ordinary person can reassemble the unit. The unit is not only adaptable for persons have a right hand swing but, those having a left hand swing are equally accessable to the training device by merely adding the arcuate extension on the opposite side of the horizontal bars provided.

Arcuate members 20 and 41 have been shown as being divided into two segments. It is obvious that they can be divided into more than two segments or not divided at all. The division merely provides a means for collapsing the golf training aid into a smaller configuration for the purpose of providing a smaller package for transportation and storage.

It is obvious, of course, that other modifications can be made and still be well within the spirit and scope of this invention as described in the specification and appended claims.

What I claim is:

1. A collapsible golf swing aid comprising:

(a) a first pair of spaced members (13,13) each having one end for securing vertically to a rigid horizontal surface and a second end;

(b) first bar means (8) attaching said second ends to form an "U" shaped member;

(c) a first bar attachment means (18) rigidly attached to said first bar means and extending beyond each side of said "U" shaped member; said first bar attachment means (18) having securing means mounted into the portions (18*a*, 18*b*) thereof extending beyond said "U" shaped member;

(d) arcuate tubular means having a mating securing means in one end for inserting over said portions of said first for attachment means for securing said arcuate tubular means into a selected position;

(e) a second pair of first and second spaced members (35, 36) each having one end for securing vertically to a rigid surface and having a second end formed at right angles to said second pair of spaced members;

(f) a second "U" shaped member (32, 34, 33) adapted to rotatably attach to said second ends of said second pair of spaced members (35, 36);

(g) releasable securing means interposed between said attachment of said second "U" shaped member and said right angle ends so that when said securing means is released, said second pair of spaced members can be rotated to a substantially compact configuration;

(h) a second bar attachment means (26) rigidly secured to said second "U" shaped member and having an extension on each side beyond said second "U" shaped member, each extension having securing means therein; and (i) a second arcuately shaped tubular means having mating securing means on each end for attachment to one of said securing means on said second bar attachment means.

2. Apparatus as claimed in claim 1 including a club deflector (62) attached angularly between said second arcuately shaped tubular means (41) and one of the second ends formed at right angles to said second pair of spaced members (35, 36), so that when a golf club is swung and gets outside said apparatus, said club will be deflected from said right angle end and said "U" shaped member.

3. Apparatus as claimed in claim 1 wherein each of said first and second pairs of spaced members (13, 13, 35, 36) have releasable attachments (15) at said one end thereof.

4. Apparatus as claimed in claim 3 wherein said releasable attachments are ground piercing points (16, 16).

5. Apparatus as claimed in claim 3 wherein said releasable attachments are "L" shaped brackets (43).

6. Apparatus as claimed in claim 1 wherein said securing means comprises mating tapered portions (30, 31).

7. Apparatus as claimed in claim 1 wherein said first and second arcuate tubular means comprise at least two interlocking segments.

8. Apparatus as claimed in claim 1 wherein each of said first and second arcuate segments includes means permitting some to be angularly rotated about its respective securing means to accommodate variations in golf swing.

* * * * *